US012070091B2

(12) United States Patent
Rodgers et al.

(10) Patent No.: US 12,070,091 B2
(45) Date of Patent: Aug. 27, 2024

(54) BELT LOOP CONNECTOR

(71) Applicant: SAMTECH, LLC, Los Angeles, CA (US)

(72) Inventors: Frances M. Rodgers, Ashland, OR (US); Tamra B. Perry, Central Point, OR (US)

(73) Assignee: SAMTECH, LLC, Los Angeles, CA (US)

( * ) Notice: Subject to any disclaimer, the term of this patent is extended or adjusted under 35 U.S.C. 154(b) by 169 days.

(21) Appl. No.: 17/815,162

(22) Filed: Jul. 26, 2022

(65) Prior Publication Data

US 2024/0032634 A1 Feb. 1, 2024

(51) Int. Cl.

| | |
|---|---|
| ***A41F 9/00*** | (2006.01) |
| ***A41F 17/00*** | (2006.01) |
| ***A41F 17/02*** | (2006.01) |
| ***A41F 17/04*** | (2006.01) |

(52) U.S. Cl.

CPC ..... *A41F 9/007* (2013.01); *A41F 17/00* (2013.01); *A41F 17/02* (2013.01); *A41F 17/04* (2013.01)

(58) Field of Classification Search

CPC ..... A41F 9/007; A41F 17/00; A41F 17/02; A41F 17/04

See application file for complete search history.

(56) References Cited

U.S. PATENT DOCUMENTS

| | | | | | |
|---|---|---|---|---|---|
| 695,629 | A * | 3/1902 | Shipley | A41D 1/04 | 2/117 |
| 932,640 | A * | 8/1909 | Pfiffner | A41D 15/00 | 2/70 |
| 1,897,261 | A * | 2/1933 | Killory | A41F 5/00 | 2/117 |
| 1,958,643 | A * | 5/1934 | Silverman | A41F 17/00 | 24/337 |
| 1,986,519 | A * | 1/1935 | Murray | A41F 17/00 | 24/698.2 |
| 1,998,085 | A * | 4/1935 | Wilcox | A41B 13/00 | 2/78.2 |
| 2,104,487 | A * | 1/1938 | Kessler | A41B 1/06 | 2/70 |
| 2,274,382 | A * | 2/1942 | Richman | A41C 3/08 | 2/73 |
| 3,418,659 | A * | 12/1968 | Brown | A41F 5/00 | 2/70 |
| 3,789,431 | A * | 2/1974 | Rand | A41F 9/007 | 2/271 |

(Continued)

*Primary Examiner* — Khaled Annis

(74) *Attorney, Agent, or Firm* — Sherman IP LLP; Kenneth L. Sherman; Hemavathy Perumal

(57) ABSTRACT

One embodiment provides a garment system comprising an upper body garment comprising an interior surface and a first set of connectors positioned on the interior surface. The system further comprises a lower body garment comprising a second set of connectors positioned on a surface of the lower body garment. The first set of connectors and the second set of connectors are vertically aligned when a wearer wears the upper body garment and the lower body garment at the same time, and each connector of the second set of connectors is configured to releasably engage and interconnect with a connector of the first set of connectors to attach the upper body garment to the lower body garment.

20 Claims, 9 Drawing Sheets

(56) References Cited

U.S. PATENT DOCUMENTS 533,373 A * 1/1985 Presby ..... A41F 15/02 2/112
4,932,079 A * 6/1990 Bridgewater ..... A41F 17/00 2/313
4,947,489 A * 8/1990 Greenwood ..... A41F 5/00 2/919
5,276,923 A * 1/1994 Cohen ..... A41F 17/00 2/229
5,309,572 A * 5/1994 Seamans ..... A41F 5/00 2/112
5,313,669 A * 5/1994 Rasdell ..... A41F 17/00 2/112
5,754,982 A * 5/1998 Gainer ..... F41H 1/02 2/2.5
6,223,352 B1 * 5/2001 Watlington ..... A41D 15/002 2/83
6,698,031 B2 * 3/2004 Lewis ..... A41F 3/00 2/340
7,047,567 B2 * 5/2006 Allen ..... A41D 13/0007 2/69
7,168,103 B2 * 1/2007 Aldridge ..... A62B 17/001 2/458
7,438,619 B2 * 10/2008 Staver ..... A41D 7/001 441/115
8,011,019 B1 * 9/2011 Hamid ..... A41D 13/018 2/69
8,813,266 B1 * 8/2014 Green ..... A41F 7/00 2/400
8,918,915 B2 * 12/2014 Caulfield ..... A41D 7/005 2/67
9,015,864 B2 * 4/2015 Evans ..... A41F 5/00 2/229
10,827,791 B2 * 11/2020 Banta ..... A41F 5/00
11,350,676 B1 * 6/2022 Law ..... A41F 17/00
2001/0000361 A1 * 4/2001 Alger ..... A41F 5/00 24/304
2003/0014802 A1 * 1/2003 Benham ..... A41D 13/02 2/69
2003/0172431 A1 * 9/2003 Allen ..... A41D 13/0007 2/69
2004/0133963 A1 * 7/2004 Jennings ..... A41D 13/1236 2/114
2006/0010559 A1 * 1/2006 Hamlet ..... A41B 1/08 2/117
2007/0101477 A1 * 5/2007 Grilliot ..... A41D 27/04 2/69
2007/0277283 A1 * 12/2007 Borowski ..... A41D 3/00 2/69
2012/0117715 A1 * 5/2012 Weafer ..... A41D 13/0015 24/3.1
2012/0204313 A1 * 8/2012 Evans ..... A41F 5/00 2/70
2012/0246805 A1 * 10/2012 Jones ..... A41F 17/00 2/400
2013/0291277 A1 * 11/2013 Kirkwood ..... A41F 17/00 2/69
2014/0101814 A1 * 4/2014 Caulfield ..... A41D 7/00 2/74
2014/0101815 A1 * 4/2014 Caulfield ..... A41F 17/00 2/400
2014/0215690 A1 * 8/2014 Caulfield ..... A41F 17/00 2/227
2014/0304899 A1 * 10/2014 Almonte ..... A41F 17/00 2/403
2015/0040285 A1 * 2/2015 Mobayyen ..... A41B 9/08 2/70
2015/0101109 A1 * 4/2015 Herman ..... A41F 17/00 2/326
2016/0324238 A1 * 11/2016 Tran ..... A41B 1/06
2017/0196283 A1 * 7/2017 Hart ..... A41D 15/00
2017/0280780 A1 * 10/2017 Janes ..... A41F 5/00
2017/0325519 A1 * 11/2017 Willingham ..... A41D 7/00
2018/0132537 A1 * 5/2018 Siegfried ..... A41F 9/00
2019/0053558 A1 * 2/2019 Spencer ..... A41F 17/00
2019/0223529 A1 * 7/2019 Park ..... A41B 1/08
2019/0246726 A1 * 8/2019 Oliva ..... A41F 17/00
2022/0030996 A1 * 2/2022 Wenkman ..... A41F 9/007
2022/0225711 A1 * 7/2022 Wenkman ..... A41F 9/007
2022/0248773 A1 * 8/2022 Ambelang ..... A41F 17/00
2023/0292864 A1 * 9/2023 Horbatuck ..... A41D 27/22 2/69

* cited by examiner

BELT LOOP CONNECTOR

TECHNICAL FIELD

One or more embodiments relate generally to garments, and in particular, a belt loop for connecting garments.

BACKGROUND

Belt loops are a series of loops around a waist level of a lower body garment (e.g., pants) that hold a belt and help to hold up the body garment on the individual wearing the garment.

SUMMARY

One embodiment provides a garment system comprising an upper body garment comprising an interior surface and a first set of connectors positioned on the interior surface. The system further comprises a lower body garment comprising a second set of connectors positioned on a surface of the lower body garment. The first set of connectors and the second set of connectors are vertically aligned when a wearer wears the upper body garment and the lower body garment at the same time, and each connector of the second set of connectors is configured to releasably engage and interconnect with a connector of the first set of connectors to attach the upper body garment to the lower body garment.

Another embodiment provides an article of clothing comprising an upper body garment and a lower body garment. The upper body garment comprises an interior surface and a first set of connectors positioned on the interior surface. The lower body garment comprises a second set of connectors positioned on a surface of the lower body garment. The first set of connectors and the second set of connectors are vertically aligned when a wearer wears the upper body garment and the lower body garment at the same time, and each connector of the second set of connectors is configured to releasably engage and interconnect with a connector of the first set of connectors to attach the upper body garment to the lower body garment.

These and other features, aspects and advantages of the one or more embodiments will become understood with reference to the following description, appended claims and accompanying figures.

DETAILED DESCRIPTION

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments relate generally to garments, and in particular, a belt loop for connecting garments. One embodiment provides a garment system comprising an upper body garment comprising an interior surface and a first set of connectors positioned on the interior surface. The system further comprises a lower body garment comprising a second set of connectors positioned on a surface of the lower body garment. The first set of connectors and the second set of connectors are vertically aligned when a wearer wears the upper body garment and the lower body garment at the same time, and each connector of the second set of connectors is configured to releasably engage and interconnect with a connector of the first set of connectors to attach the upper body garment to the lower body garment.

Another embodiment provides an article of clothing comprising an upper body garment and a lower body garment. The upper body garment comprises an interior surface and a first set of connectors positioned on the interior surface. The lower body garment comprises a second set of connectors positioned on a surface of the lower body garment. The first set of connectors and the second set of connectors are vertically aligned when a wearer wears the upper body garment and the lower body garment at the same time, and each connector of the second set of connectors is configured to releasably engage and interconnect with a connector of the first set of connectors to attach the upper body garment to the lower body garment.

Figure 1A:
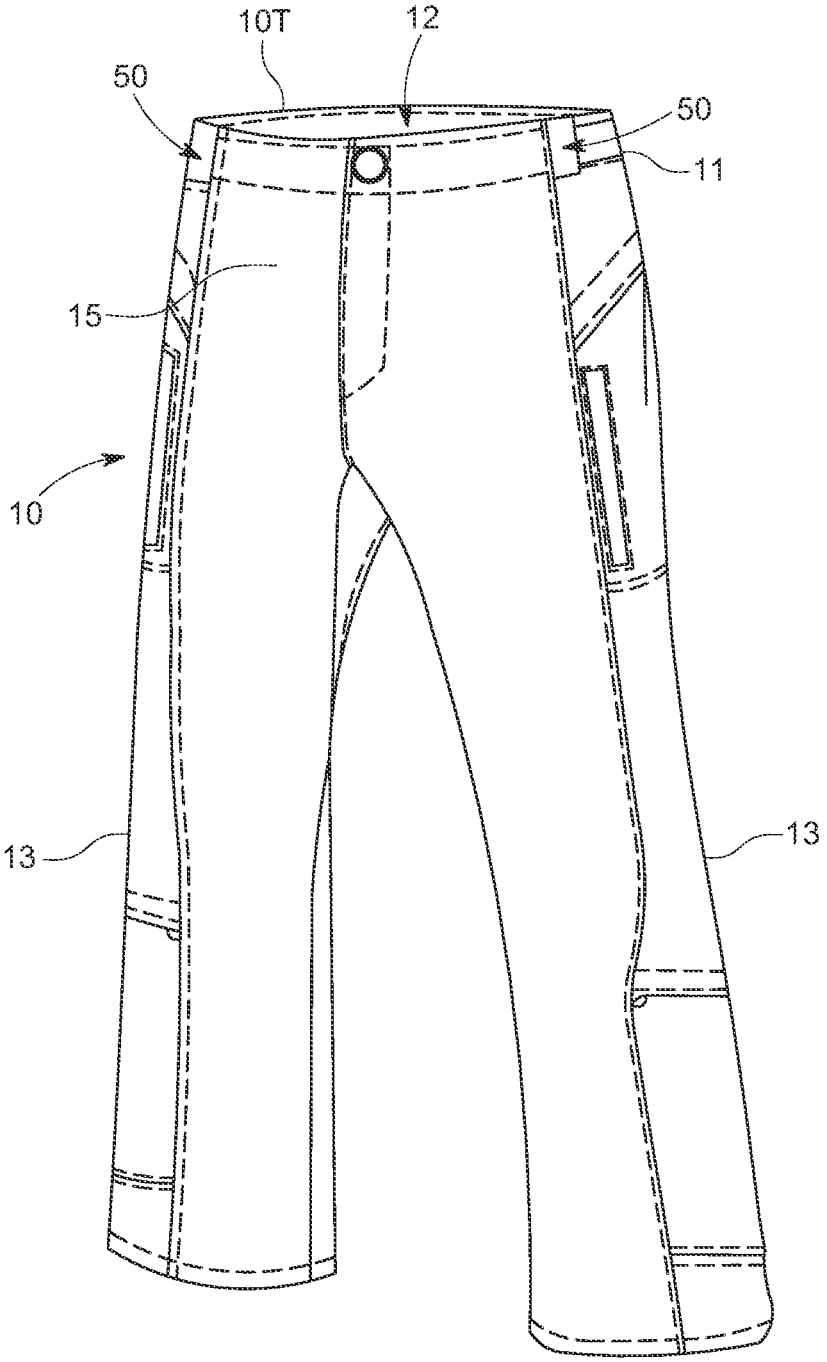
FIG. 1A illustrates an example lower body garment, in one or more embodiments.
Figure 1B:
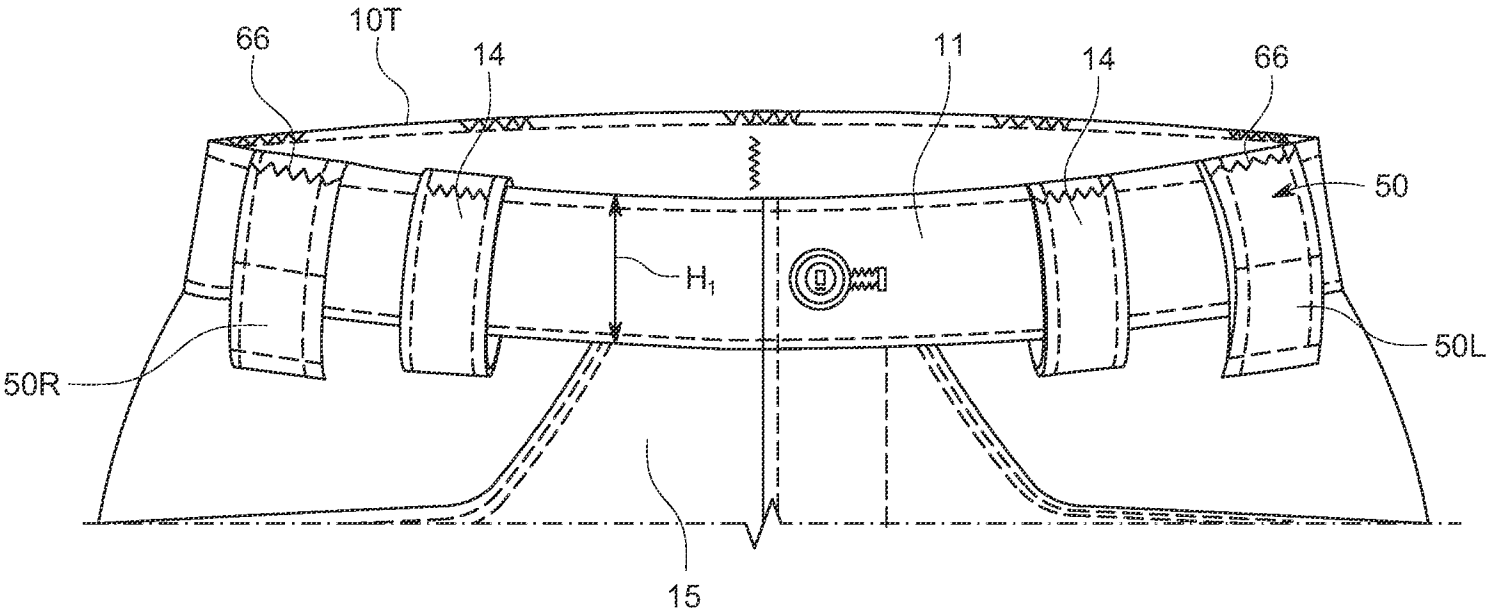
FIG. 1B illustrates a front view of the waistband area of the lower body garment in FIG. 1A, in one or more embodiments.

FIG. 1A illustrates an example lower body garment 10, in one or more embodiments. The lower body garment 10 is intended to be worn by a wearer. The lower body garment 10 comprises, but is not limited to, pants, shorts, etc. The lower body garment 10 includes a waistband area 11 extending downwards from a top edge 10T of the lower body garment 10 for a distance of about Hi (FIG. 1B). For example, in one embodiment, the distance Hi of the waistband area 11 is about 2 inches.

The top edge 10T defines a waist opening 12. The lower body garment 10 further includes two garment legs 13 providing two leg openings. Specifically, each garment leg 13 includes a leg opening designed/shaped for receiving a lower limb of the wearer, wherein the garment leg 13 covers (i.e., partially covers or fully covers) the lower limb. The waist opening 12 is opposite of the leg openings.

Figure 2A:
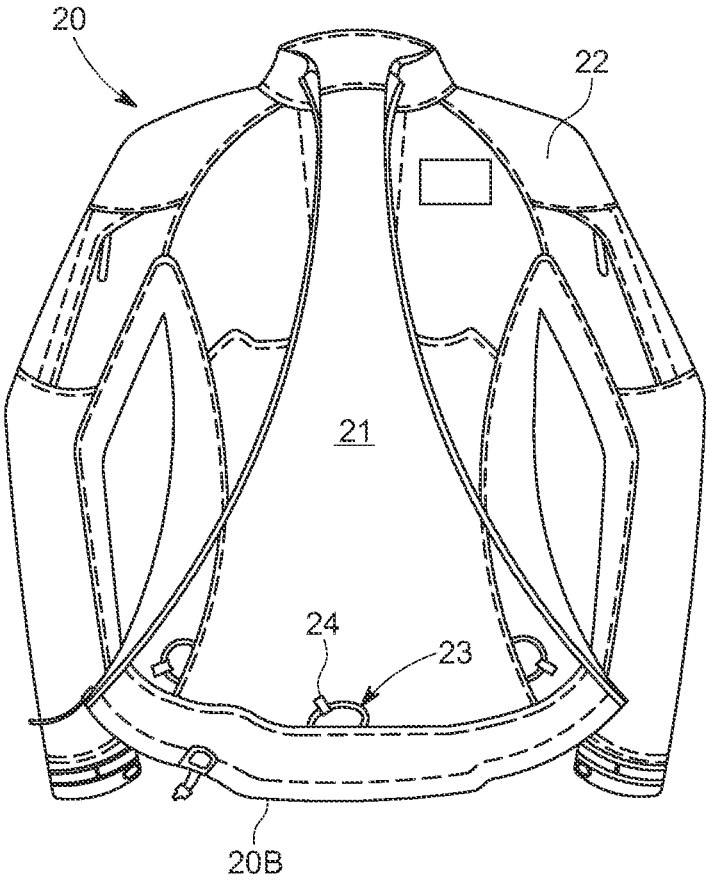
FIG. 2A illustrates an example upper body garment, in one or more embodiments.

As shown in FIG. 1A, the lower body garment 10 includes one or more connectors 50 that are spaced apart and encircle the waistband area 11. In one embodiment, the connectors 50 are located on an exterior surface 15 of the lower body garment 10. In another embodiment, the connectors 50 are located on an interior surface of the lower body garment 10. As described in detail later herein, each connector 50 is located within proximity of the top edge 10T to releasably engage and interconnect with a corresponding connector 23 (FIG. 2A) of an upper body garment 20 (FIG. 2A). The lower body garment 10 and the upper body garment 20 attach together to form a unitary and integrated protective covering 30 (FIG. 4D) for the wearer that can protect the wearer from extreme weather and other hazardous conditions (e.g., flight suits worn by pilots, garments worn by firefighters, military personnel, industrial workers, etc.). For example, in one embodiment, the garments 10 and 20 are made from a fabric that is flame resistant or flame retardant, thereby protecting the wearer from flash fires, explosions, and open flames.

The lower body garment 10 may include a plurality of optional belt loops 14 (FIG. 1B) that are spaced apart and encircle the waistband area 11. Each belt loop 14 includes an opening designed/shaped for receiving a belt that encircles the waistband area 11. In one embodiment, the connectors 50 and the belt loops 14 are spaced apart along the waistband area 11. In another embodiment, the connectors 50 are located on top of the belt loops 14, such that at least one belt loop 14 includes a corresponding connector 50 on top the belt loop 14 (i.e., attached to an exterior surface of the belt loop 14).

Figure 1C:
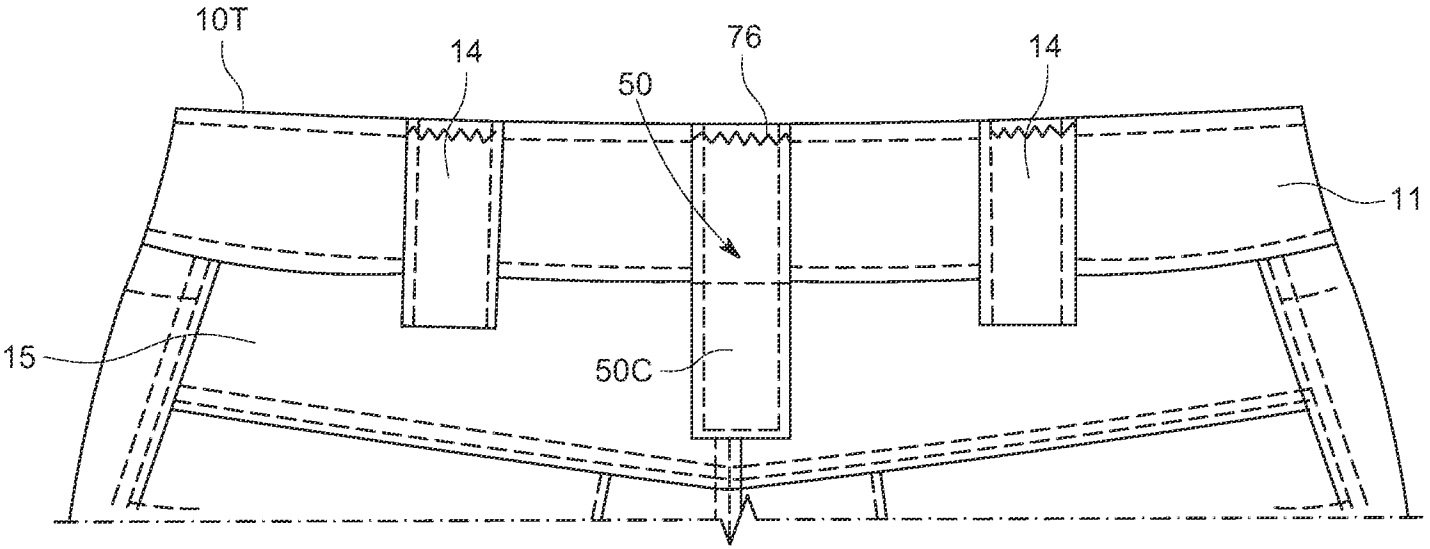
FIG. 1C illustrates a back view of the waistband area of the lower body garment in FIG. 1A, in one or more embodiments.

FIG. 1B illustrates a front view of the waistband area 11 of the lower body garment 10 in FIG. 1A, in one or more embodiments. FIG. 1C illustrates a back view of the waistband area 11 of the lower body garment 10 in FIG. 1A, in one or more embodiments. As shown in FIG. 1B, in one embodiment, the connectors 50 include, on a front side of the waistband area 11, a first side connector 50R and a second side connector 50L located to the right and to the left, respectively, of a center of the waistband area 11. As shown in FIG. 1C, in one embodiment, the connectors 50 further include, on a rear side of the waistband area 11, a center connector 50C located at about the center of the waistband area 11.

In one embodiment, each connector 50 comprises a retaining member.

FIG. 2A illustrates an example upper body garment 20, in one or more embodiments. The upper body garment 20 is intended to be worn by a wearer. The upper body garment comprises, but is not limited to, a jacket, a coat, a shirt (e.g., a combat shirt), etc.

The upper body garment 20 includes an interior surface 21 and an opposite exterior surface 22. The interior surface 21 includes one or more connectors 23 that are spaced apart and spaced from a bottom edge 20B of the upper body garment 20. As described in detail later herein, each connector 23 is located within proximity of the bottom edge 20B to releasably engage and interconnect with a corresponding connector 50 (FIGS. 1A-1C) of the lower body garment 10.

In one embodiment, each connector 23 includes an optional tab member 24 that allows the wearer of the upper body garment 20 to more easily locate the connector 23 and pull on the tab member 24 when attaching the connecter 23 to a corresponding connector 50 of the lower body garment 10.

Figure 2B:
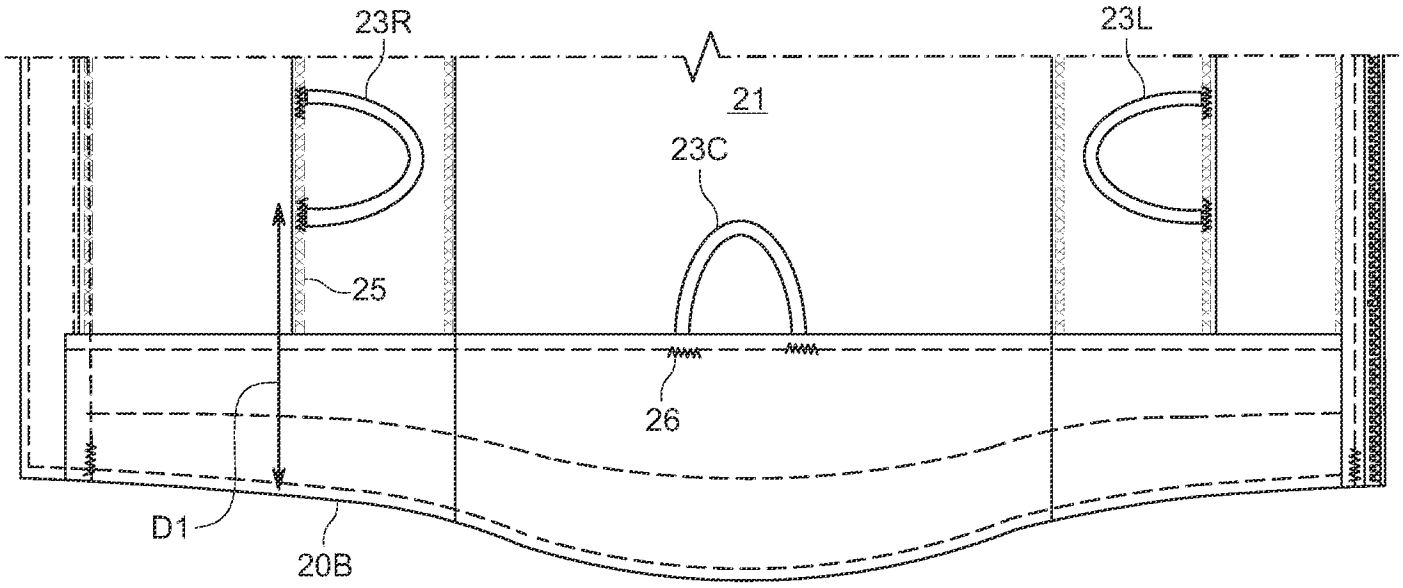
FIG. 2B illustrates the bottom edge of the upper body garment in FIG. 2A, in one or more embodiments.

FIG. 2B illustrates the bottom edge 20B of the upper body garment 20 in FIG. 2A, in one or more embodiments. As shown in FIG. 2B, in one embodiment, the connectors 23 include a first side connector 23R located to a right of a center of the interior surface 21, a second side connector 23L located to a left of the center of the interior surface 21, and a center connector 23C located at about the center of the interior surface 21. In one embodiment, the connectors 23 are spaced from the bottom edge 20B a distance Di of about 0.5 inches to about 12 inches. For example, in one embodiment, the connectors 23 are spaced about 4 inches from the bottom edge 20B.

As shown in FIG. 2B, in one embodiment, each connector 23 comprises a half-loop member. Each connector 23 may be made from a cord, such as an elastic cord or a shock cord, with two ends. The ends of each connector 23 are spaced apart and permanently attached to a seam 25 of the interior surface 21 via bartacks 26 (i.e., the ends are bartacked). In sewing, a bartack is a stitch or a series of stitches used to reinforce parts of a garment that may be subject to stress or additional wear (e.g., belt loops, pocket corners, etc.). For example, in one embodiment, the ends of the connectors 23R and 23L are spaced apart by a distance of about 1.75 inches, and the ends of the connector 23C are spaced apart by a distance of about 3 inches. In one embodiment, a length of each bartack 26 is about 0.25 inches.

As stated above, each connector 23 of the upper body garment 20 corresponds to a particular connector 50 of the lower body garment 10 that the connector 23 releasably engages and interconnects with. With reference to FIGS. 1B and 2B, the first side connector 23R of the upper body garment 20 corresponds to the first side connector of the lower body garment 10, such that the connectors 23R and 50R releasably engage and interconnect with each other to secure a right portion of the upper body garment 20 to the lower body garment 10. With reference to FIGS. 1B and 2B, the second side connector 23L of the upper body garment 20 corresponds to the second side connector 50L of the lower body garment 10, such that the connectors 23L and 50L releasably engage and interconnect with each other to secure a left portion of the upper body garment 20 to the lower body garment 10. With reference to FIGS. 1C and 2B, the center connector 23C of the upper body garment 20 corresponds to the center connector of the lower body garment 10, such that the connectors 23C and 50C releasably engage and interconnect with each other to secure a center portion of the upper body garment 20 to the lower body garment 10. The connectors 23R, 23L, and 23C are in vertical alignment with the connectors 50R, 50L, and 50C when the garments 10 and 20 are donned by the wearer.

In another embodiment, the structure of the connectors 50 of the lower body garment 10 and the connectors 23 of the upper body garment 20 are reversed, such that the connectors 50 comprise half-loop members and the connectors 23 comprise retaining members instead. In yet another embodiment, the connectors 50 of the lower body garment 10 comprise a first combination of half-loop members and retaining members, and the connectors 23 of the upper body garment 20 comprise a second combination of half-loop members and retaining members complementary to the first combination (i.e., each half-loop member of one garment releasably engages and interconnects with a corresponding retaining member of another garment).

Figure 3B:
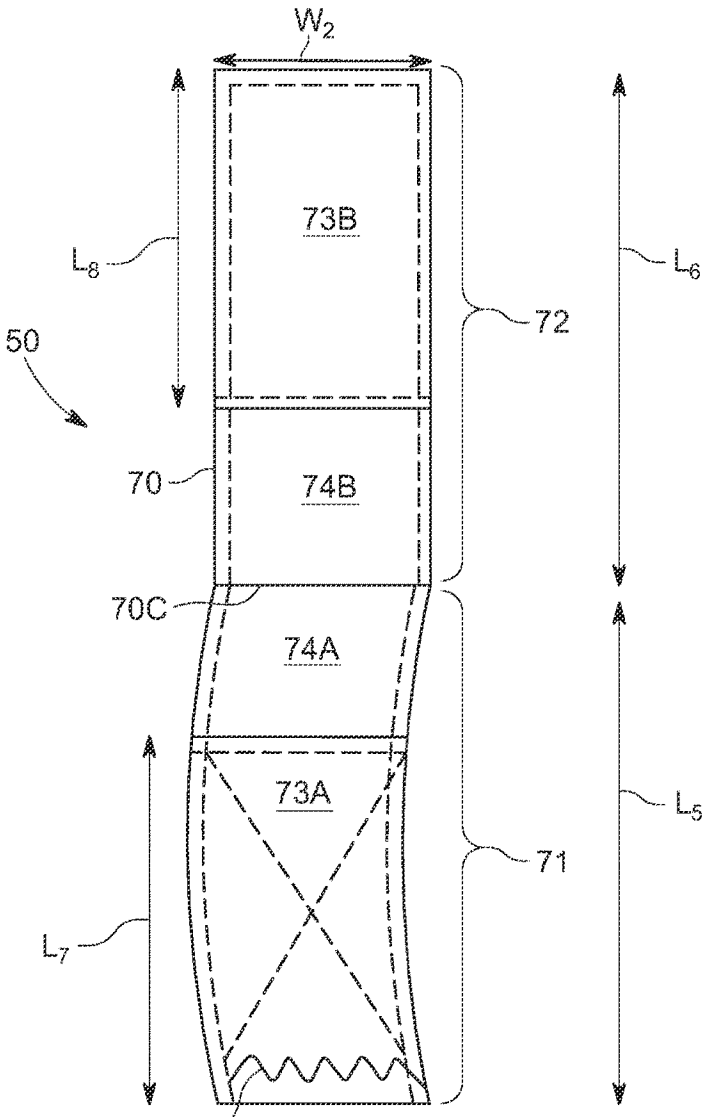
FIG. 3B illustrates an example connector of the lower body garment, wherein the connector is a center connector, in one or more embodiments.
Figure 3A:
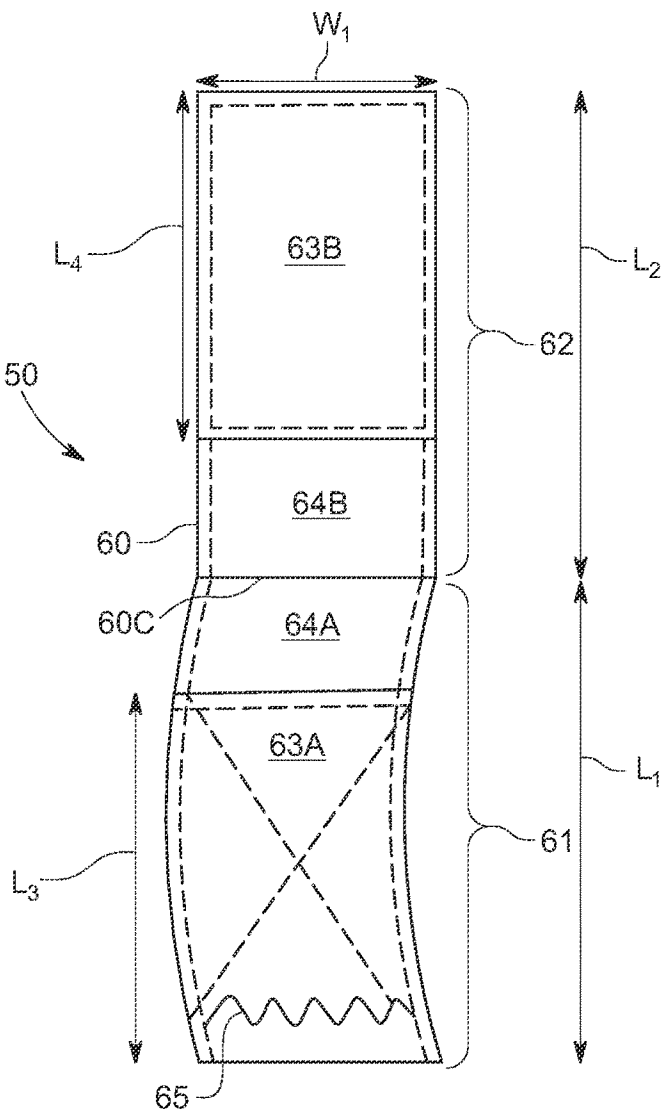
FIG. 3A illustrates an example connector of the lower body garment, wherein the connector is a side connector, in one or more embodiments.

FIG. 3A illustrates an example connector 50 of the lower body garment 10, wherein the connector 50 is a side connector 50R or 50L, in one or more embodiments. In one embodiment, each side connector 50R, 50L comprises a one-piece retaining member 60. The retaining member 60 is foldable at about a center 60C into two ends/segments of about equal length. Specifically, the retaining member 60 includes a belt loop end 61 adjacent to the waistband area 11, and a flap end 62 that is opposite of the belt loop end 61. The belt loop end 61 and the flap end 62 form one continuous piece.

One or more portions of the retaining member 60 are directly and permanently attached to the lower body garment 10. For example, in one embodiment, the center 60C of the retaining member 60 is directly and permanently attached to the exterior surface 15 of the lower body garment 10 via a bartack 66 (FIG. 1B) (i.e., the retaining member 60 is bartacked) sewn at about the center 60C. In one embodiment, the bartack 66 is located about 0.125 inches from the top edge 10T of the lower body garment 10.

As another example, in one embodiment, a portion of the belt loop end 61 is directly and permanently attached to the lower body garment 10. For example, in one embodiment, a bottom edge of the belt loop end 61 is directly and permanently attached to the exterior surface 15 of the lower body garment 10 via a bartack 65 (i.e., the belt loop end 61 is bartacked) sewn at about the bottom edge. In one embodiment, a length of the bartack 65 is about 0.875 inches.

A portion of the belt loop end 61 that is in between the bartacks 65 and 66 form an opening 51 (FIGS. 4B-4C) designed/shaped for receiving a belt that encircles the waistband area 11.

The retaining member 60 includes a fastener. In one embodiment, the fastener is a hook and loop fastener (e.g., Velcro hook and loop). Specifically, the belt loop end 61 includes a loop fastening material 63A of the fastener, and the flap end 62 includes a hook fastening material 63B of the fastener. In one embodiment, the belt loop end 61 includes an area 64A within proximity of the center 60C that does not include the loop fastening material 63A, and the flap end 62 includes an area 64B within proximity of the center 60C that does not include the hook fastening material 63B. In one embodiment, the areas 64A and 64B are lined with webbing. Without any fastening materials 63A and 63B, the areas 64A and 64B provide more vertical room for receiving and securing a connector 23, and make it more likely for the fastening materials 63A and 63B to vertically align. Further, there is less surface area for dirt and other debris to get caught in the fastening materials 63A and 63B, thereby causing less wear and tear to the hook and loop fastener over time.

In another embodiment, the locations of the hook fastening material 63B and the loop fastening material 63A are reversed, such that the belt loop end 61 includes the hook fastening material 63B and the flap end 62 includes the loop fastening material 63A instead.

The flap end 62 is a flap that is releasably attached to the lower body garment 10 via the fastener. For example, in one embodiment, aligning and pressing the flap end 62 on top of and against the belt loop end 61 causes the hook fastening material 63B to engage and fasten to the loop fastening material 63A. In FIG. 3A, the flap end 62 is in an open position, i.e., the hook fastening material 63B is not engaged and fastened to the loop fastening material 63A.

In one embodiment, a length of the retaining member 60 is about 6.125 inches. In one embodiment, the length includes a length $L_1$ from a bottom edge of the belt loop end 61 to the center 60C, and another length $L_2$ from a top edge of the flap end 62 to the center 60C. In one embodiment, the lengths $L_1$ and $L_2$ are substantially similar. For example, in one embodiment, each of the lengths $L_1$ and $L_2$ is about 2.5 inches.

In one embodiment, a length $L_3$ of the loop fastening material 63A is substantially similar to a length $L_4$ of the hook fastening material 63B, such that the surface areas of the materials 63A, 63B are similarly sized for better grip. For example, in one embodiment, each of the lengths $L_3$ and $L_4$ is about 1.5 inches.

In one embodiment, a width $W_1$ of the retaining member 60 is about 1 inch.

In another embodiment, the fastener is another type of fastener such as, but not limited to, a snapfit connector (e.g., a cantilever snap, an annular snap, a trap, a dart, etc.), a push-pull connector, a buckle, a retaining ring, a snap, a cantilever spring fastener, a crush rib fastener, a carabiner, etc.

FIG. 3B illustrates an example connector 50 of the lower body garment 10, wherein the connector 50 is a center connector 50C, in one or more embodiments. In one embodiment, the center connector 50C comprises a one-piece retaining member 70. The retaining member 70 is foldable at about a center 70C into two ends of about equal length. Specifically, the retaining member 70 includes a belt loop end 71 adjacent to the waistband area 11, and a flap end 72 that is opposite of the belt loop end 71. The belt loop end 71 and the flap end 72 form one continuous piece.

One or more portions of the retaining member 70 are directly and permanently attached to the lower body garment 10. For example, in one embodiment, the center 70C of the retaining member 70 is directly and permanently attached to the exterior surface 15 of the lower body garment 10 via a bartack 76 (FIG. 1C) (i.e., the retaining member 70 is bartacked) sewn at about the center 70C. In one embodiment, the bartack 76 is located about 0.125 inches from the top edge 10T of the lower body garment 10.

As another example, in one embodiment, a portion of the belt loop end 71 is directly and permanently attached to the lower body garment 10. For example, in one embodiment, a bottom edge of the belt loop end 71 is directly and permanently attached to the exterior surface 15 of the lower body garment 10 via a bartack 75 (i.e., the belt loop end 71 is bartacked) sewn at about the bottom edge. In one embodiment, a length of the bartack 75 is about 0.875 inches.

A portion of the belt loop end 71 that is in between the bartacks 75 and 76 form an opening 51 (FIGS. 4B-4C) designed/shaped for receiving a belt that encircles the waistband area 11.

The retaining member 70 includes a fastener. In one embodiment, the fastener is a hook and loop fastener (e.g., Velcro hook and loop). Specifically, the belt loop end 71 includes a loop fastening material 73A of the fastener, and the flap end 72 includes a hook fastening material 73B of the fastener. In one embodiment, the belt loop end 71 includes an area 74A within proximity of the center 70C that does not include the loop fastening material 73A, and the flap end 72 includes an area 74B within proximity of the center 70C that does not include the hook fastening material 73B. In one embodiment, the areas 74A and 74B are lined with webbing. Without any fastening materials 73A and 73B, the areas 74A and 74B provide more vertical room for receiving and securing a connector 23, and make it more likely for the fastening materials 73A and 73B to vertically align. Further, there is less surface area for dirt and other debris to get caught in the fastening materials 73A and 73B, thereby causing less wear and tear to the hook and loop fastener over time.

In another embodiment, the locations of the hook fastening material 73B and the loop fastening material 73A are reversed, such that the belt loop end 71 includes the hook fastening material 73B and the flap end 72 includes the loop fastening material 73A instead.

The flap end 72 is a flap that is releasably attached to the lower body garment 10 via the fastener. For example, in one embodiment, aligning and pressing the flap end 72 on top of and against the belt loop end 71 causes the hook fastening material 73B to engage and fasten to the loop fastening material 73A. In FIG. 3B, the flap end 72 is in an open position, i.e., the hook fastening material 73B is not engaged and fastened to the loop fastening material 73A.

In one embodiment, a length of the retaining member 70 is about 8.125 inches. In one embodiment, the length includes a length $L_5$ from a bottom edge of the belt loop end 71 to the center 70C, and another length $L_6$ from a top edge of the flap end 72 to the center 70C. In one embodiment, the lengths $L_5$ and $L_6$ are substantially similar. For example, in one embodiment, each of the lengths $L_5$ and $L_6$ is about 3.5 inches.

In one embodiment, a length $L_7$ of the loop fastening material 73A is substantially similar to a length $L_8$ of the hook fastening material 73B, such that the surface areas of the materials 73A, 73B are similarly sized for better grip. For example, in one embodiment, each of the lengths $L_7$ and $L_8$ is about 2.25 inches.

In one embodiment, a width $W_2$ of the retaining member 70 is about 1 inch.

In another embodiment, the fastener is another type of fastener such as, but not limited to, a snapfit connector (e.g., a cantilever snap, an annular snap, a trap, a dart, etc.), a push-pull connector, a buckle, a retaining ring, a snap, a cantilever spring fastener, a crush rib fastener, a carabiner, etc.

Figure 4C:
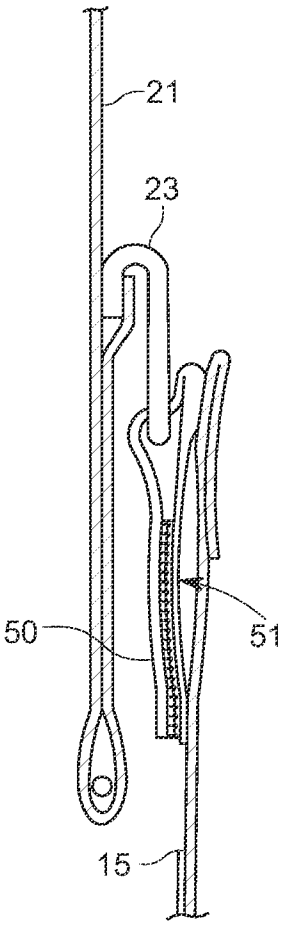
FIG. 4C illustrates the example connector of the lower body garment interconnected with the example connector of the upper body garment, in one or more embodiments.
Figure 4B:
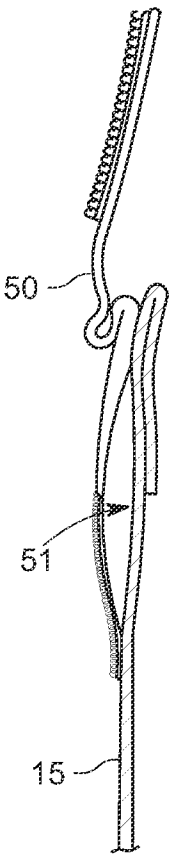
FIG. 4B illustrates a side view of the example connector of the lower body garment in the open position to engage and interconnect with the example connector of the upper body garment, in one or more embodiments.
Figure 4A:
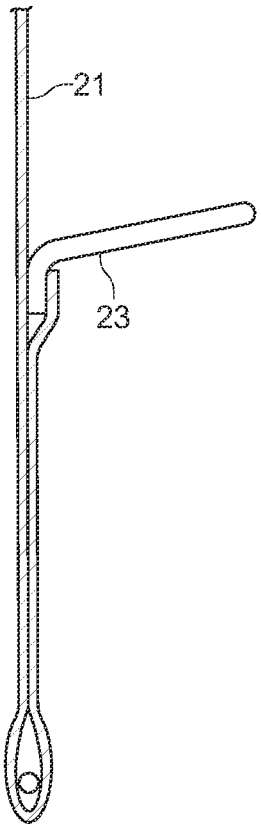
FIG. 4A illustrates a front view of an example connector of the lower body garment in an open position to engage and interconnect with an example connector of the upper body garment, in one or more embodiments.
Figure 4A:
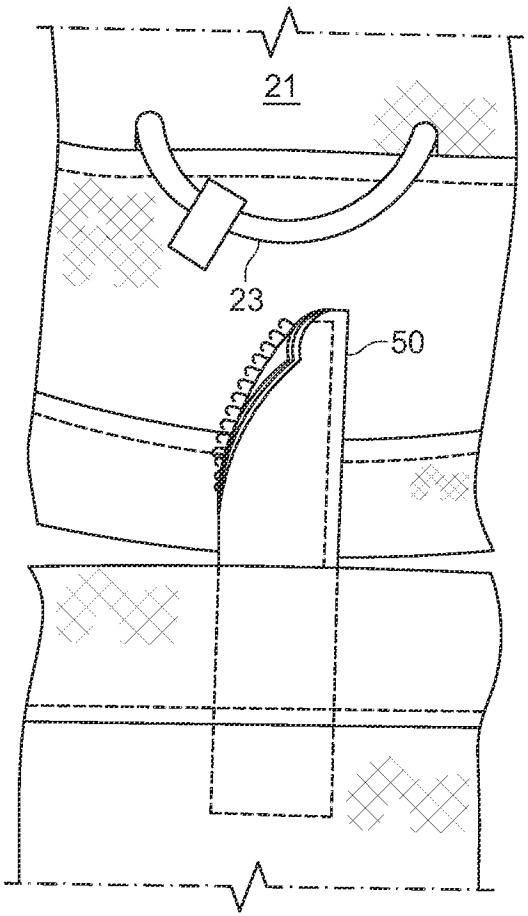
Figure 4D:
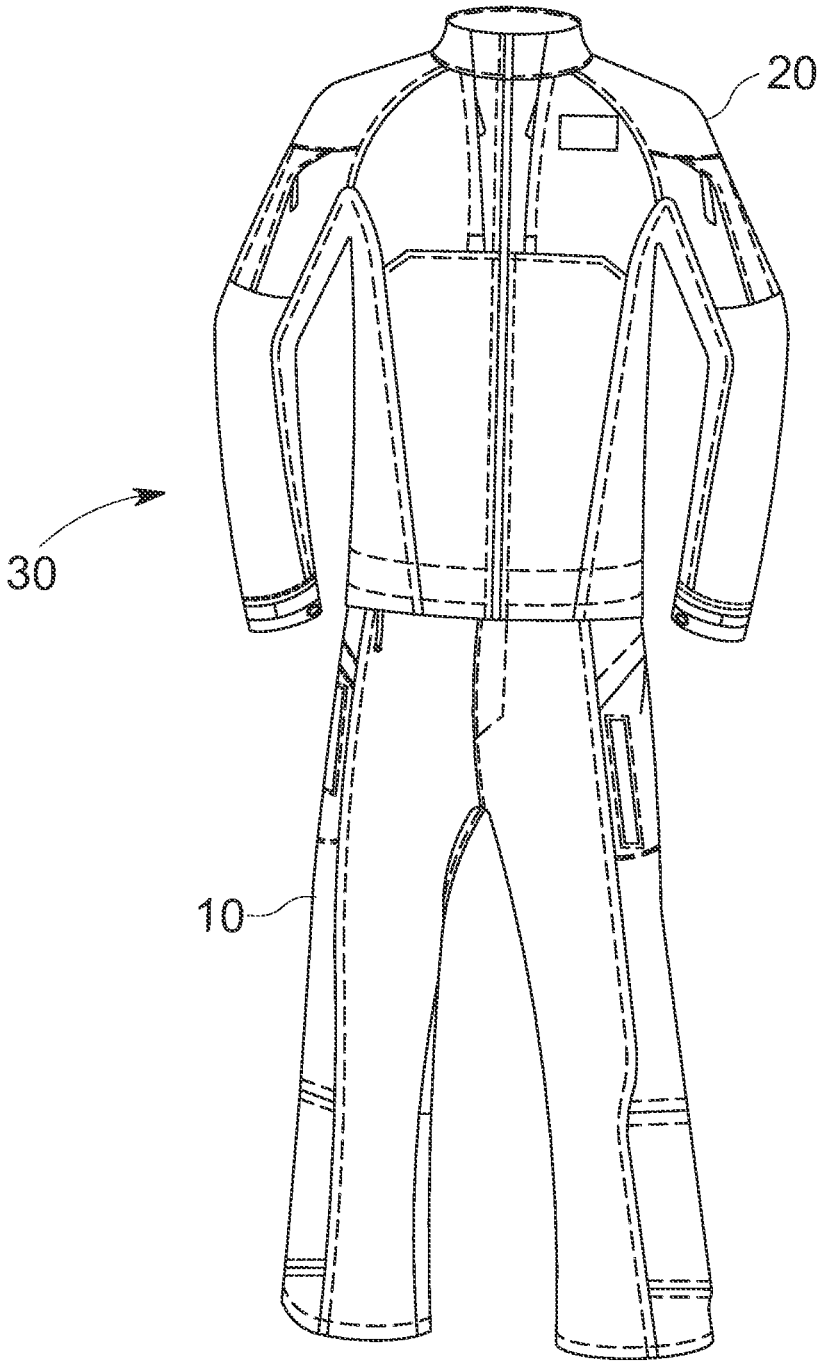
FIG. 4D illustrates the garments attached together to form a unitary and integrated protective covering, in one or more embodiments.

FIG. 4A illustrates a front view of an example connector 50 of the lower body garment 10 in an open position to engage and interconnect with an example connector 23 of the upper body garment 20, in one or more embodiments. FIG. 4B illustrates a side view of the example connector 50 in the open position to engage and interconnect with the example connector 23, in one or more embodiments. FIG. 4C illustrates the example connector 50 interconnected with the example connector 23, in one or more embodiments. FIG. 4D illustrates the garments 10 and 20 attached together to form a unitary and integrated protective covering 30, in one or more embodiments. Once a wearer wears both the lower body garment 10 and the upper body garment 20, the garments 10 and 20 can be attached together by engaging and interconnecting each connector 50 of the lower body garment 10 with a corresponding connector 23 of the upper body garment 20. For example, connectors 50R, 50L, and 50C of the lower body garment 10 are interconnected with connectors 23R, 23L, and 23C of the upper body garment 20, respectively.

To attach a connector 50 with a corresponding connector 23, a fastener (e.g., hook and loop fasteners shown in FIGS. 3A-3B) of the connector 50 is released, causing a flap end (e.g., flap ends 62 and 72 shown in FIGS. 3A-3B) of the connector 50 to pivot upwards into an open position. When the flap end is in the open position, the wearer can pull on the connector 23 located on the interior surface 21 of the upper body garment 20 and bring the connector 23 in close proximity to the flap end. The wearer places the flap end within the connector 23 (e.g., the flap end is placed through an opening formed by the half-loop member of the connector 23). Once the flap end has engaged the connector 23, the flap end can be pivoted in a down wards direction into a closed position, as shown in FIG. 4C. When in the closed position, the fastener engages (e.g., hook fastening materials 63B, 73B and loop fastening materials 63A, 73A shown in FIGS. 3A-3B engage) causing a secure attachment between the connectors 50 and 23.

Once the upper body garment 20 is attached to the lower body garment 10, the upper body garment 20 is prevented from being forced up and separating from the lower body garment 10 and exposing the wearer.

Figure 5:
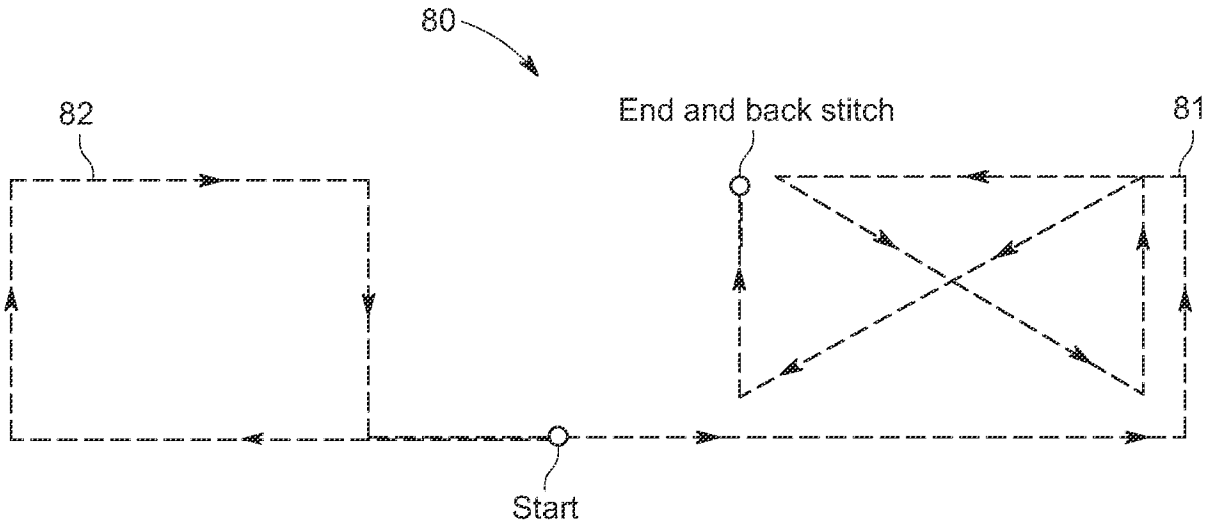
FIG. 5 illustrates an example pattern for stitching a hook and loop fastener to a connector, in one or more embodiment.

FIG. 5 illustrates an example pattern 80 for stitching a hook and loop fastener to a connector 50, in one or more embodiments. Loop fastening material (e.g., 63A, 73A in FIGS. 3A-3B) of the fastener is sewn to a belt loop end (e.g., 61, 71 in FIGS. 3A-3B) of the connector 50 along a path 81 that forms an X for extra reinforcement. Hook fastening material (e.g., 63B, 73B in FIGS. 3A-3B) of the fastener is sewn to a flap end (e.g., 62, 72 in FIGS. 3A-3B) of the connector 50 along a path 82 that forms a square/rectangle. In one embodiment, a bottom edge of the belt loop end and a top edge of the flap end are turned under and caught in the stitching for reinforcement. Stitching is visible on an exterior of the flap end to provide a wearer with a visual aid for aligning the hook fastening material to the loop fastening material.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A garment system comprising:

an upper body garment comprising:

an interior surface; and a first set of connectors positioned on the interior surface;

a lower body garment comprising:

a second set of connectors positioned on a surface of the lower body garment;

wherein the first set of connectors and the second set of connectors are vertically aligned when a wearer wears the upper body garment and the lower body garment at the same time, and each connector of the second set of connectors is configured to releasably engage and interconnect with a connector of the first set of connectors to attach the upper body garment to the lower body garment; and wherein each connector of the second set of connectors comprises one continuous piece that is foldable at about a center to form a belt loop end and a flap end, the belt loop end including a first area with loop fastening material and a second area without any loop fastening material, the flap end including a third area with hook fastening material and a fourth area without any hook fastening material, and a size of the first area with the loop fastening material is substantially similar to a size of the third area with hook fastening material, such that, when the connector of the second set of connectors engages and interconnects with a connector of the first set of connectors, the second area without any loop fastening material and the fourth area without any hook fastening material provide vertical room for receiving and securing the connector of the first set of connectors, and the third area with the hook fastening material is engaged and fastened to an entirety of the first area with the loop fastening material.

2. The garment system of claim 1, wherein each connector of the first set of connectors comprises a half-loop member.

3. The garment system of claim 1, wherein each continuous piece of each connector of the second set of connectors comprises a retaining member.

4. The garment system of claim 3, wherein each belt loop end of each connector of the second set of connectors is directly and permanently attached to the surface of the lower body garment, and each flap end of each connector of the second set of connectors is removably attached from the lower body garment.

5. The garment system of claim 4, wherein a size of a belt loop end of a connector of the second set of connectors is substantially similar to a size of a flap end of the same connector.

6. The garment system of claim 4, wherein each connector of the second set of connectors includes a fastener.

7. The garment system of claim 6, wherein, for each connector of the second set of connectors, a second area without any loop fastening material and a fourth area without any hook fastening material of the connector of the second set of connectors reduces surface area for debris getting caught in the same connector, and both the second area without any loop fastening material and the fourth area without any hook fastening material are lined with webbing.

8. The garment system of claim 7, wherein each loop fastening material is attached to each belt loop end of each connector of the second set of connectors via stitching along a path that forms an X, and one edge of the belt loop end is turned under and caught in the stitching.

9. The garment system of claim 7, wherein each hook fastening material is attached to each flap end of each connector of the second set of connectors via stitching, and one edge of the flap end is turned under and caught in the stitching.

10. The garment system of claim 1, wherein each connector of the second set of connectors is permanently attached to a waistband area on the surface of the lower body garment via one or more bartacks.

11. An article of clothing comprising:

an upper body garment comprising:

an interior surface; and a first set of connectors positioned on the interior surface;

a lower body garment comprising:

a second set of connectors positioned on a surface of the lower body garment;

wherein the first set of connectors and the second set of connectors are vertically aligned when a wearer wears the upper body garment and the lower body garment at the same time, and each connector of the second set of connectors is configured to releasably engage and interconnect with a connector of the first set of connectors to attach the upper body garment to the lower body garment; and wherein each connector of the second set of connectors comprises one continuous piece that is foldable at about a center to form a belt loop end and a flap end, the belt loop end including a first area with loop fastening material and a second area without any loop fastening material, the flap end including a third area with hook fastening material and a fourth area without any hook fastening material, and a size of the first area with the loop fastening material is substantially similar to a size of the third area with hook fastening material, such that, when the connector of the second set of connectors engages and interconnects with a connector of the first set of connectors, the second area without any loop fastening material and the fourth area without any hook fastening material provide vertical room for receiving and securing the connector of the first set of connectors, and the third area with the hook fastening material is engaged and fastened to an entirety of the first area with the loop fastening material.

12. The article of clothing of claim 11, wherein each connector of the first set of connectors comprises a half-loop member.

13. The article of clothing of claim 11, wherein each continuous piece of each connector of the second set of connectors comprises a retaining member.

14. The article of clothing of claim 13, wherein each belt loop end of each connector of the second set of connectors is directly and permanently attached to the surface of the lower body garment, and each flap end of each connector of the second set of connectors is removably attached from the lower body garment.

15. The article of clothing of claim 14, wherein a size of a belt loop end of a connector of the second set of connectors is substantially similar to a size of a flap end of the same connector.

16. The article of clothing of claim 14, wherein each connector of the second set of connectors includes a fastener.

17. The article of clothing of claim 16, wherein, for each connector of the second set of connectors, a second area without any loop fastening material and a fourth area without any hook fastening material of the connector of the second set of connectors reduces surface area for debris getting caught in the same connector, and both the second area without any loop fastening material and the fourth area without any hook fastening material are lined with webbing.

18. The article of clothing of claim 17, wherein each loop fastening material is attached to each belt loop end of each connector of the second set of connectors via stitching along a path that forms an X, and one edge of the belt loop end is turned under and caught in the stitching.

19. The article of clothing of claim 17, wherein each hook fastening material is attached to each flap end of each connector of the second set of connectors via stitching, and one edge of the flap end is turned under and caught in the stitching.

20. The article of clothing of claim 11, wherein each connector of the second set of connectors is permanently attached to a waistband area on the surface of the lower body garment via one or more bartacks.

* * * * *